US007621476B2

(12) United States Patent
Jakobi et al.

(10) Patent No.: US 7,621,476 B2
(45) Date of Patent: Nov. 24, 2009

(54) CUTTER KNIFE

(75) Inventors: Norbert Jakobi, Biedenkopf-Wallau (DE); Jürgen Bernhardt, Biedenkopf-Wallau (DE)

(73) Assignee: CFS Germany GmbH (DE)

( * ) Notice: Subject to any disclaimer, the term of this patent is extended or adjusted under 35 U.S.C. 154(b) by 175 days.

(21) Appl. No.: 10/588,250

(22) PCT Filed: Feb. 2, 2005

(86) PCT No.: PCT/EP2005/001011

§ 371 (c)(1),
(2), (4) Date: May 21, 2007

(87) PCT Pub. No.: WO2005/072879

PCT Pub. Date: Aug. 11, 2005

(65) Prior Publication Data

US 2008/0029629 A1 Feb. 7, 2008

(30) Foreign Application Priority Data

Feb. 2, 2004 (DE) ..... 10 2004 005 158
Jan. 28, 2005 (DE) ..... 20 2005 001 466 U

(51) Int. Cl.
*B02C 18/18* (2006.01)

(52) U.S. Cl. ..... 241/101.3; 83/356.3; 83/522.27; 241/292.1

(58) Field of Classification Search ..... 241/292.1, 241/101.3; 83/522.27, 596, 665, 675, 356.3
See application file for complete search history.

(56) References Cited

U.S. PATENT DOCUMENTS 2,721,593 A 10/1955 Schaller ..... 146/67

FOREIGN PATENT DOCUMENTS

| | | |
|---|---|---|
| AT | 348 886 | 7/1978 |
| AT | 348886 B | 3/1979 |
| DE | 1757 972 | 12/1971 |
| DE | 1 757 972 | 1/1973 |
| DE | 196 06 188 A1 | 8/1996 |
| DE | 197 56 635 A1 | 6/1998 |

*Primary Examiner*—Mark Rosenbaum
(74) *Attorney, Agent, or Firm*—Perman & Green LLP

(57) ABSTRACT

The invention relates to a cutter knife (8), a cutter head disk (1) and a system including the inventive cutter head disk and the inventive knife, wherein the cutter knife includes a longitudinal bore enabling only one cutter knife to be arranged on the cutter head disk, the longitudinal bore thereof being compatible with the pin. The scaling on the longitudinal bore makes it possible to verify the position of the cutter knife in relation to the cutter head disk.

9 Claims, 4 Drawing Sheets

CUTTER KNIFE

This application is the National Stage of International Application No. PCT/EP2005/001011, International Filing Date, 2 Feb. 2005, which designated the United States of America, and which international application was published under PCT Article 21(2) as Wo Publication No. WO 2005/072879 A1 and which claims priority from German Application No. 10 2004 055 158.2, filed 2 Feb. 2004, and German Application No. 20 2005 001 466.4 filed 28 Jan. 2005.

The present invention relates to a cutter knife, a cutter head disk, and a cutter head comprising the inventive cutter head disk and the inventive knife.

Cutter knives for the comminuting and mixing of fresh or frozen foodstuffs, such as meat, exhibit a cutter head, which consists of a plurality of knives arranged one behind another, which are secured to what are referred to as cutter head disks. The knives must be arranged in a quite specific configuration, in order for a satisfactory cutting result to be obtained. In addition to this, in order to obtain a good cutting result and also for reasons of safety, it is important that specific knives be combined only with the cutter head disks intended for them, which with the knives and cutter head disks according to the prior are was not always guaranteed.

The object of the present invention was therefore to provide a cutter knife which does not exhibit the disadvantages of the prior art.

The object is resolved according to the invention with a knife according to Patent claim 1. Preferred embodiments of the inventive knife are claimed in the Sub-claims 2 and 3.

It was entirely surprising for the person skilled in the art and not to be expected that the inventive knife can be used only on cutter head disks for them. The knives cannot be inserted with the sides the wrong way round, with the result that the inventive knife provides an installation aid for the operating personnel.

According to the invention, the knife exhibits at least one means with which it can be attached to the cutter head disk. In addition, it exhibits a cut-out or aperture offset to the mid-axis of the knife, which, during the mounting of the knife in the cutter disk head, accommodates a projection arranged in the cutter disk head.

This aperture may be of any shape and size familiar to the person skilled in the art. For preference, however, it is a longitudinal hole, the width of which essentially corresponds to the diameter of a preferentially cylindrical pin, which projects out of the cutter head disk into the longitudinal hole. In a particularly preferred embodiment, the longitudinal hole has a scaling. This embodiment of the present invention has the advantage that, thanks to the longitudinal hole, a check can be made as to whether the knife has adopted a previously determined position relative to the cutter head disk. In addition, with the scaling it can be determined whether, with the securing means correctly sited, an original knife must be inserted on the individual cutter head disk or one which has already been ground.

A further object of the present invention is a cutter head disk for a meat cutter, to which at least one knife can be attached and which exhibits a pin which is not arranged on its mid-axis and which does not serve to secure the knife to the cutter head disk.

The inventive cutter head disk has the advantage that only knives can be attached to it which exhibit an aperture of which the shape, size, and location are compatible to the projection in the cutter head disk. In addition, the inventive cutter head disk provides an installation aid for the operating personnel, with which the risk can be prevented of the knives being inserted the wrong way round in the cutter head disk.

For preference the cutter head disk has at least one aperture into which at least one eccentric retaining pin can be inserted in each case. The location of the knife in the cutter head disk is determined with the eccentric retaining pin. With regard to the eccentric retaining pin and the corresponding locating of the knife in the cutter head disk, reference is made to the parallel patent application DE 103 16 303.4, which is hereby introduced as a reference and is therefore deemed to constitute a part of the disclosure.

A further object of the present invention is a cutter head disk for a meat cutter, in which at least one knife can be fitted, which has for preference a metallic core for accommodating the drive shaft, whereby the core is surrounded by a casing, for preference a plastic casing, and the casing is shrunk onto the core. This cutter head disk is characterised by a very good bond between the casing and the core, which ca even resist the high forces incurred at high revolution speeds.

A further object of the present invention is a cutter head comprising the inventive cutter head disk and at least one inventive knife, with which the eccentric retaining pins of the cutter head disk are introduced into the holes of the knives and the projections present according to the invention in the cutter head disk project into the apertures present in the knives.

It was entirely surprising for the person skilled in the art and not to be expected that, with the cutter head according to the invention an incorrect combination of knives and cutter head disks can be excluded. In addition, with the inventive cutter head the possibility can be prevented of the knives being arranged the wrong way round on the cutter head disks. Thanks to the scaling of the longitudinal holes in the knives, the position of the knives relative to the cutter head disks can be checked.

A further object of the present invention is a device with means for securing an inventive knife, such as a rotating table, and means located at a distance from this with which the correct position of the eccentric pin can be determined.

With the inventive device the correct position of the eccentric pins can be determined.

The invention is explained hereinafter on the basis of FIGS. 1 to 4. These explanations are for example only, do not restrict the general thinking of the invention, and apply equally to the inventive knife, the inventive cutter head disk, the inventive cutter head, and the inventive checking device.

Figure 1:
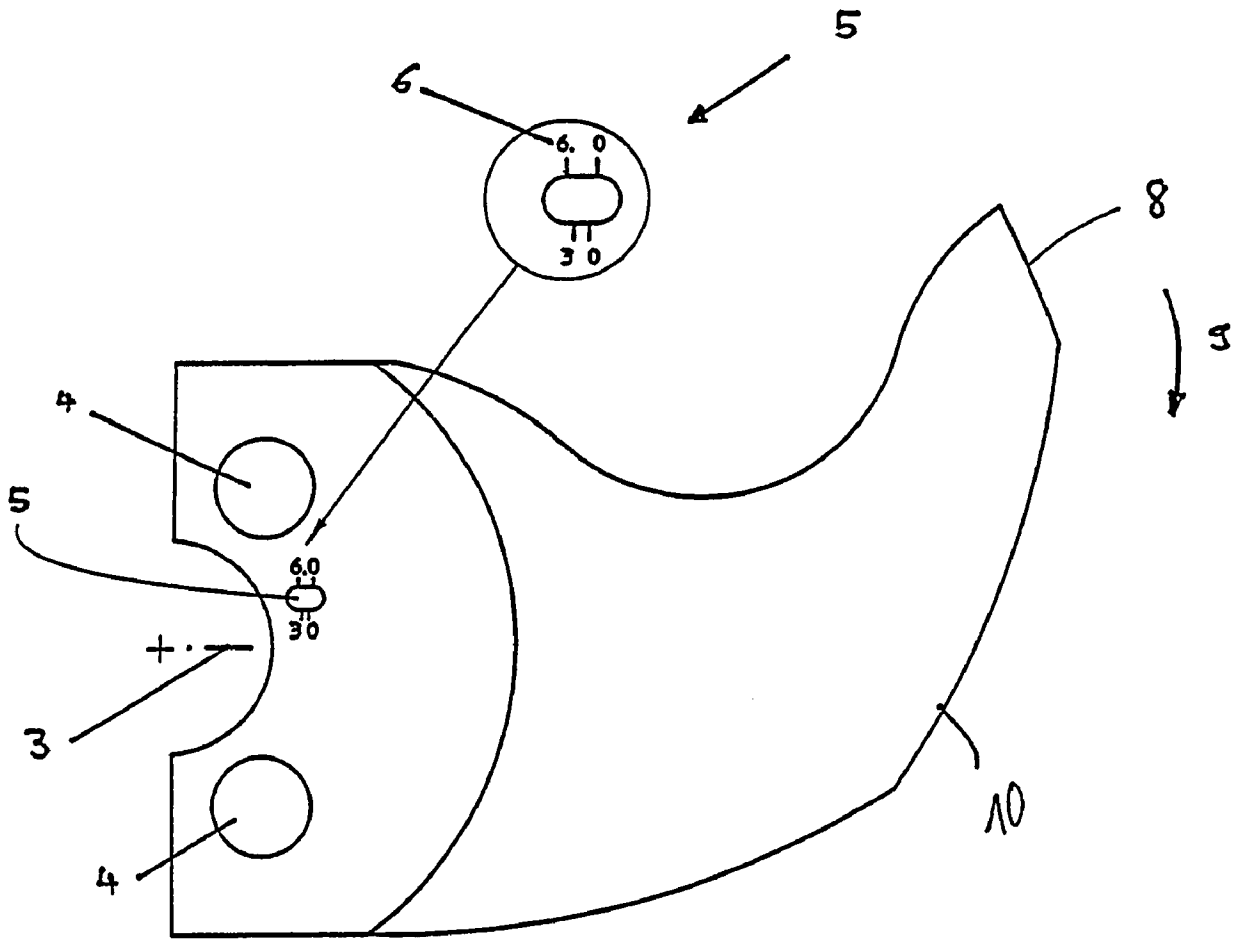
FIG. 1 shows the inventive knife
Figure 2:
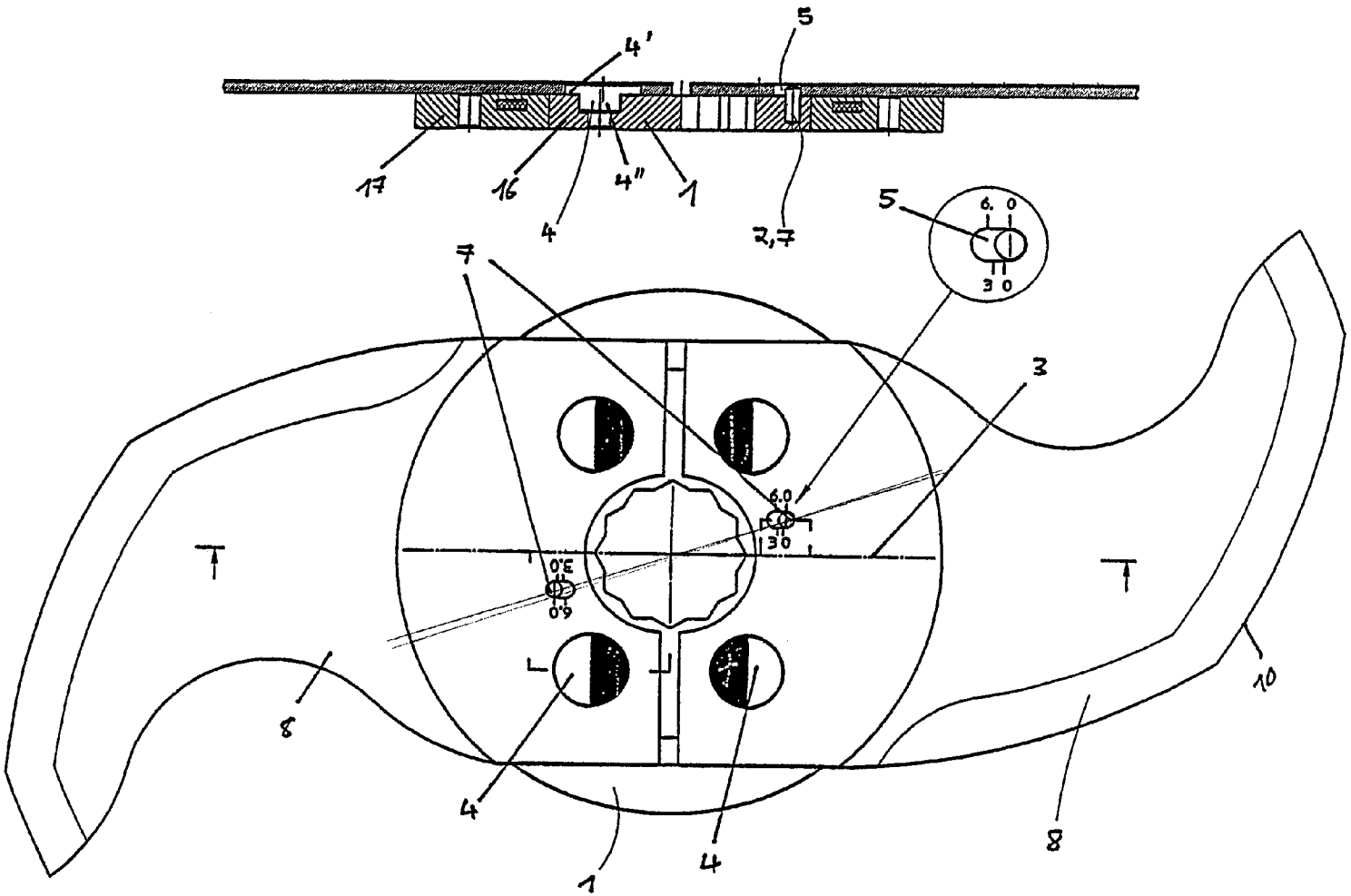
FIG. 2 shows two original knives which are arranged on a cutter head disk
Figure 3:
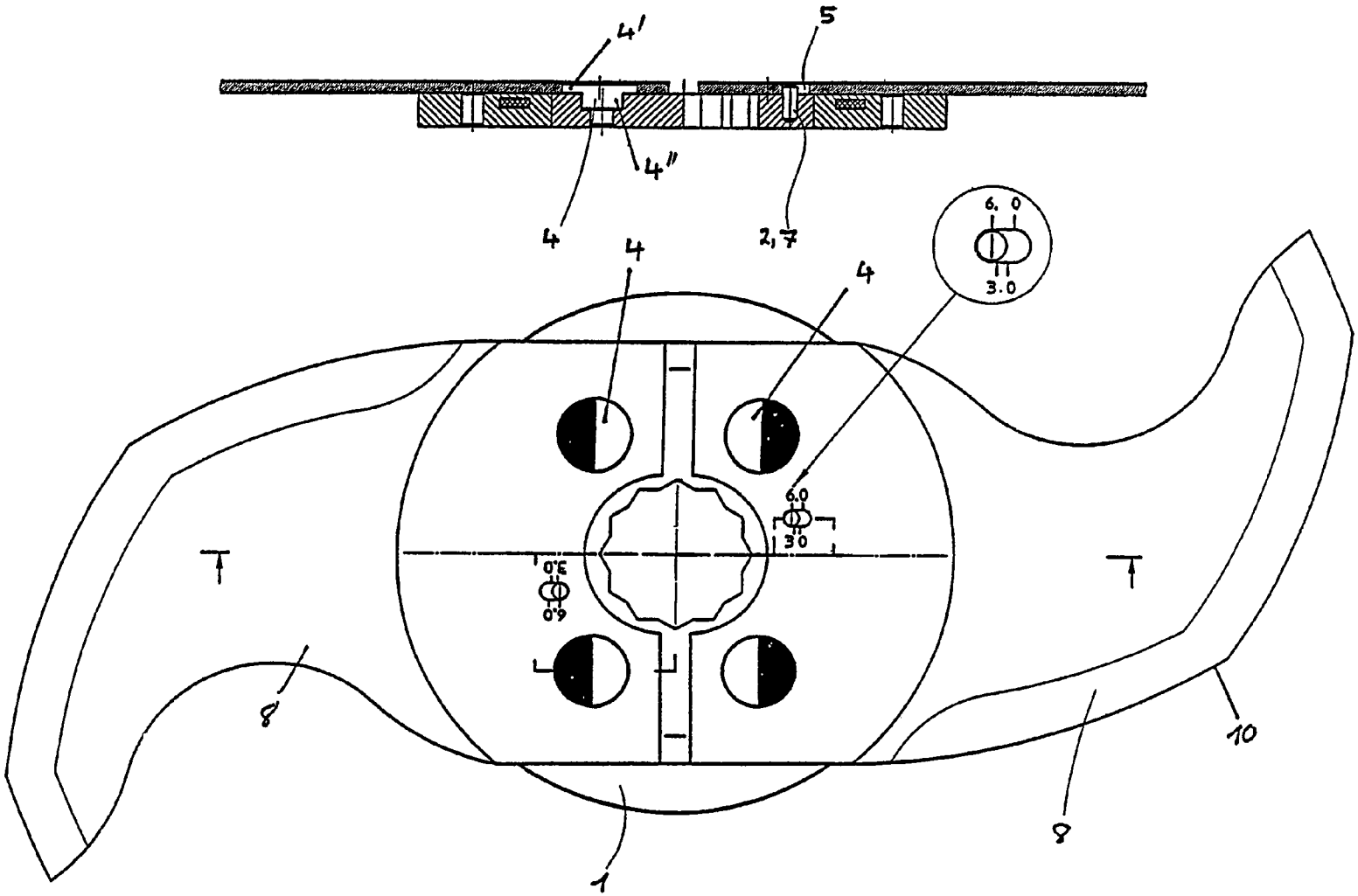
Figure 4:
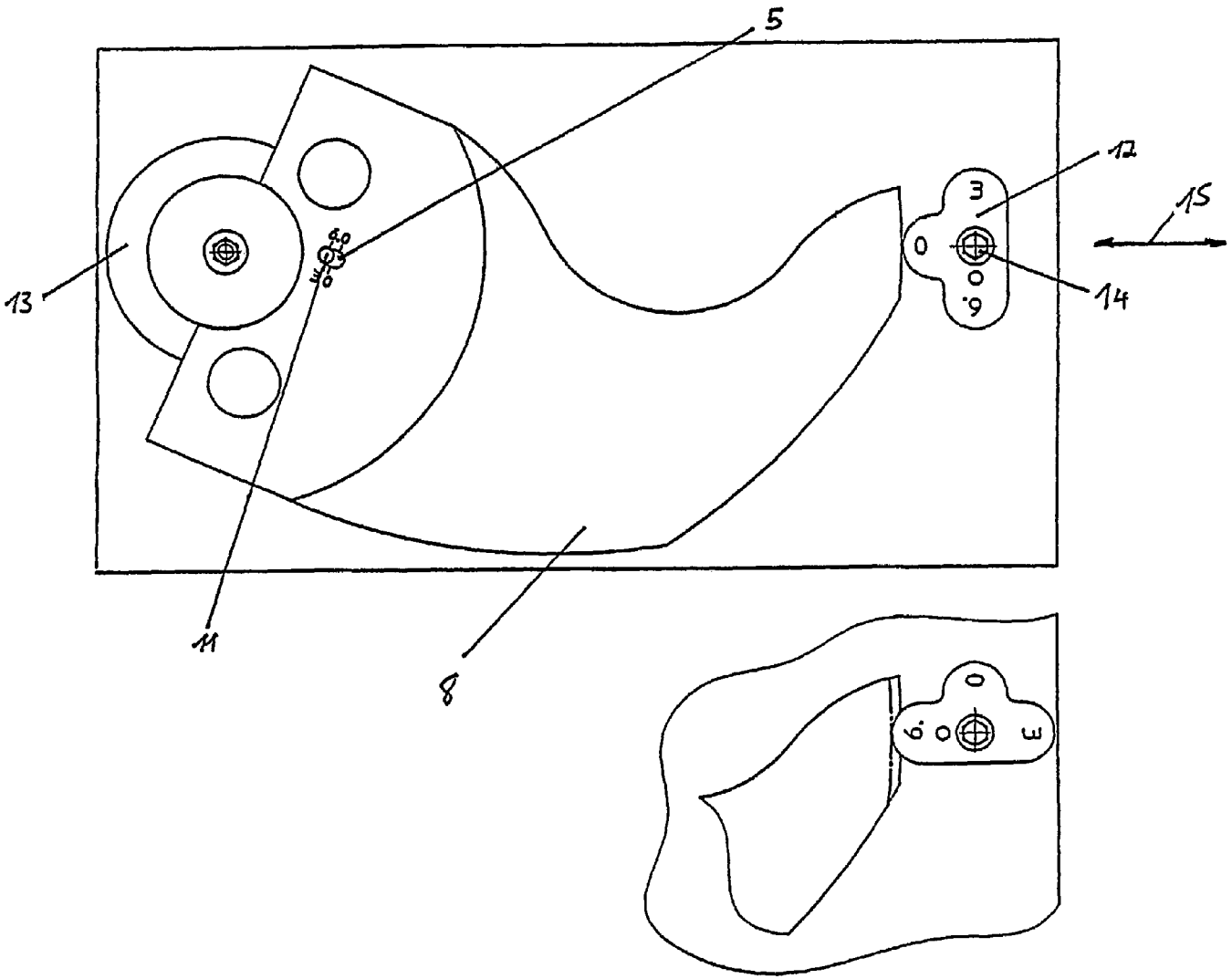

FIG. 3 shows the combination of knives and cutter head disk according to FIG. 2, whereby, in the present case, however, these knives have been shortened at the tips FIG. 4 shows the inventive checking device In FIG. 1 the inventive knife 8 is represented, which rotates in a cutter (not shown) according to an arrow represented by the reference FIG. 9. Accordingly, the knife has on its lower radius a blade 10. The knife is located in the cutter head disk by the two holes 4. According to the invention, the knife has a longitudinal hole 5, which is arranged offset to the mid-axis of the knife 8. This longitudinal hole 8 has a scaling with which the position of the knife relative to the cutter head disk can be identified, which is explained in greater detail in FIGS. 2 and 3.

FIG. 2 shows two knives 8, which are arranged in a cutter head disk 1. The cutter head disk 1 has four cut-outs or apertures, which each accommodate an eccentric retaining pin 4, with which the knives 8 are located in the cutter head disk 1. The eccentric retaining pins 4 have a circular diskshaped head 4', which is arranged eccentrically at its foot 4", whereby the areas marked in black project further from the middle than the areas marked white. This eccentric arrangement allows for the knife with the pins to be arranged in two different positions in the cutter head disk. A cutter head disk is supplied as a set with several eccentric retaining pins, which, however, only differ in the degree of their eccentricity. The head 4' and the foot 4" are in each case identical. In addition to this, a pin 7 is arranged in the cutter head disk, which projects into the aperture 5. The pin is arranged on none of the axes of symmetry of the cutter head disk, and offset to the mid-axis 3 of the knife, so that the knives cannot be located mirror-image reversed in the cutter head disk, which would result in the blade 10 of the knife not being arranged in the direction of rotation of the cutter disk head. In addition, the pin prevents knives being fitted on the cutter head disk which do not have a corresponding hole. As can be seen from the enlarged circular section, the aperture 5 has a scaling, which corresponds to the eccentric retaining pin in each case. The upper scaling is selected for an eccentric retaining pin with which the knife can be arranged on the cutting head disk in a 0 setting or displaced 6 mm outwards. Correspondingly, the lower scaling is provided for an eccentric retaining pin with which the knife can be arranged in the 0 setting or displaced 3 mm outwards. In the present case, this involves knives which have never yet been shortened in their length. Accordingly, the line on the pin corresponds to the scaling 0. The cutter head disk consists of a metallic core 16, which is surrounded by a plastic ring 17. In the present case, the plastic ring is shrunk onto the metallic core. For this purpose, the core 16 is cooled and/or the plastic ring is heated.

FIG. 3 shows the cutter head disk/knife arrangement according to FIG. 2, whereby the knife tips in the present case have been shortened by 6 mm. Accordingly, the eccentric pins have been rotated from their 0 setting into the 6 mm setting, in order to guarantee that the distance interval between the knife tip and the cutter key remains constant. This rotation of the eccentric disk can also be identified by way of the scaling, because the line on the pin 7 is no longer located in the 0 setting but in the 6 mm setting. The person skilled in the art will recognise that the scaling allows on the one hand for a check to be made as to whether the knife is located on the correct pin, and whether, with the pin located correctly, a shortened knife must be used, or a knife of the original length.

FIG. 4 shows the inventive device for checking the knife length after grinding. To do this, the knife 8 is laid on a rotating table 13 and secured to the device by means of a pin 11, which in turn projects into the aperture 5. At a distance from the rotating table 13, the inventive device has a template, with which the length of the knife can be checked. The template 12 can be rotated about the screw 14 clockwise and anti-clockwise by 90° in each case and fixed in the corresponding position. Depending on the size of the cutter, the template 12, as well as being fixed, can also be displaced in the direction represented by the double arrow 15. In the upper representation an original knife, the tip of which has not yet been shortened, is tensioned on the device. Accordingly, the template is in the 0 setting, which also corresponds to the arrangement according to FIG. 2. The lower representation illustrates the situation after the knife has been shortened. By means of the template, it has been determined that the knife has been shortened by 6 mm, and the operator knows that the eccentric pin must be brought into a corresponding position.

REFERENCE LIST

1 Cutter head disk
2 Projection
3 Mid-axis
4 Means for attaching the knife to the cutter head disk
5 Cut-out or aperture
6 Scaling
7 Pin
8 Knife
9 Direction of rotation of knife
10 Blade
11 Means for securing a knife to the checking device
12 Means for determining the correct setting of the eccentric pins
13 Rotating table
14 Screw
15 Double arrow
16 Core
17 Casing

The invention claimed is:

1. A knife head comprising:

at least one knife head disc for a meat cutter and at least one knife, the knife having at least one means with which the knife can be attached to the at least one knife head disc and an aperture that is offset from the center axis of the knife and is configured to accommodate a pin in the knife head disc, wherein the aperture is an elongated hole that has a scale;

wherein the at least one knife is attached to the knife head disc by eccentric retaining pins in the knife head disc, the eccentric retaining pins being inserted into the aperture of the at least one knife, and a correct positioning of the at least one knife being identified by the scale.

2. The knife head according to claim 1 wherein a correct positioning of the eccentric retaining pins is detected with reference to the scale.

3. The knife head according to claim 1 further comprising that the knife head disc is a metallic core that accommodates a drive shaft, the core being enclosed by a plastic casing shrunk onto the core.

4. The knife according to claim 1 wherein a rotated position of the eccentric pins corresponds to a position of the pin in the knife head disc relative to the scale.

5. The knife head according to claim 1 wherein each eccentric pin is rotatable to correspond to a length of a knife tip in order to maintain a constant distance between the knife tip and a cutter key.

6. The knife head according to claim 1, wherein each knife is attached to the knife head disc by a pair of eccentric pins, wherein a position of each knife on the knife head disc is determined by a rotated position of the pair of eccentric pins.

7. The knife head according to claim 6 wherein the rotated position of the pair of eccentric pins is detected by a location of the pin in the elongated hole.

8. The knife head according to claim 6 wherein the rotated position of the pair of eccentric pins can be varied to displace a tip of the knife outwards a distance of approximately 3 mm or 6 mm from a neutral position.

9. The knife head according to claim 8 wherein the rotated position of the pair of eccentric pins determines a position of the pin in the elongated hole.

* * * * *